US010801308B2

(12) United States Patent
Hardesty

(10) Patent No.: US 10,801,308 B2
(45) **Date of Patent: *Oct. 13, 2020**

(54) WELLBORE GUN PERFORATING SYSTEM AND METHOD

(71) Applicant: GEODYNAMICS, INC., Millsap, TX (US)

(72) Inventor: John T. Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,196

(22) Filed: Jul. 18, 2019

(65) Prior Publication Data

US 2019/0360315 A1 Nov. 28, 2019

Related U.S. Application Data

(63) Continuation of application No. 15/831,054, filed on Dec. 4, 2017, now Pat. No. 10,408,024, which is a (Continued)

(51) Int. Cl.
*E21B 29/02* (2006.01)
*E21B 43/116* (2006.01)
(Continued)

(52) U.S. Cl.
CPC ..... *E21B 43/1185* (2013.01); *E21B 29/02* (2013.01); *E21B 43/116* (2013.01);
(Continued)

(58) Field of Classification Search
CPC .... E21B 43/1185; E21B 29/02; E21B 43/116; E21B 43/11; F42D 1/05; F42D 1/055
See application file for complete search history.

(56) References Cited

U.S. PATENT DOCUMENTS 2,545,024 A 3/1951 Elliott
2,655,619 A 10/1953 Neal
(Continued)

OTHER PUBLICATIONS

International Search Report and Written Opinion, dated Dec. 23, 2015, from corresponding/related International Application No. PCT/US2015/046169.
(Continued)

*Primary Examiner* — Daniel P Stephenson
(74) *Attorney, Agent, or Firm* — Patent Portfolio Builders PLLC

(57) ABSTRACT

A wellbore perforating system and method with reliable and safer connections in a perforating gun assembly is disclosed. The system/method includes a gun string assembly (GSA) deployed in a wellbore with multiple perforating guns attached to plural switch subs. The perforating guns are pre-wired with a cable having multi conductors; the multi conductors are connected to electrical ring contacts on either end of the perforating guns. The switch subs are configured with electrical contacts that are attached to the electrical contacts of the perforating guns without the need for manual electrical connections and assembly in the field of operations. The system further includes detonating with a detonator that is positioned upstream of the perforating gun. The detonator is wired to a switch that is positioned downstream of the perforating gun.

20 Claims, 14 Drawing Sheets

Related U.S. Application Data continuation of application No. 15/293,069, filed on Oct. 13, 2016, now Pat. No. 9,835,015, which is a continuation of application No. 14/887,067, filed on Oct. 19, 2015, now Pat. No. 9,689,238, which is a continuation of application No. 14/627,872, filed on Feb. 20, 2015, now Pat. No. 9,194,219.

(51) Int. Cl.

| | |
|---|---|
| ***E21B 43/1185*** | (2006.01) |
| ***F42D 1/045*** | (2006.01) |
| ***F42D 1/06*** | (2006.01) |
| ***F42D 1/05*** | (2006.01) |
| ***F42D 1/055*** | (2006.01) |
| ***E21B 43/119*** | (2006.01) |
| *E21B 43/117* | (2006.01) |

(52) U.S. Cl.

CPC ..... *E21B 43/119* (2013.01); *F42D 1/045* (2013.01); *F42D 1/05* (2013.01); *F42D 1/055* (2013.01); *F42D 1/06* (2013.01); *E21B 43/117* (2013.01)

(56) References Cited

U.S. PATENT DOCUMENTS

| | | | |
|---|---|---|---|
| 2,946,283 | A | 7/1960 | Udry |
| 2,968,243 | A | 1/1961 | Turechek |
| 3,010,396 | A | 11/1961 | Coleman |
| 3,173,992 | A | 3/1965 | Boop |
| 3,246,707 | A | 4/1966 | Bell |
| 3,378,069 | A | 4/1968 | Fields |
| 3,648,785 | A | 3/1972 | Walker |
| 4,234,768 | A | 11/1980 | Boop |
| 5,042,594 | A | 8/1991 | Gonzalez et al. |
| 5,531,164 | A | 7/1996 | Mosley |
| 6,095,258 | A | 8/2000 | Reese et al. |
| 6,752,083 | B1 | 6/2004 | Lerche et al. |
| 7,574,318 | B2 | 8/2009 | Hsieh |
| 8,365,825 | B1 | 2/2013 | Yarbro |
| 8,875,787 | B2 | 11/2014 | Tassaroli |
| 8,875,796 | B2 | 11/2014 | Hales et al. |
| 9,194,219 | B1 | 11/2015 | Hardesty et al. |
| 9,291,040 | B1 | 3/2016 | Hardesty et al. |
| 9,689,238 | B2 | 6/2017 | Hardesty et al. |
| 9,759,049 | B2 | 9/2017 | Hardesty et al. |
| 9,759,050 | B2 | 9/2017 | Hardesty et al. |
| 9,835,015 | B2 | 12/2017 | Hardesty |
| 10,408,024 | B2 * | 9/2019 | Hardesty ..... F42D 1/05 |
| 2003/0001753 | A1 | 1/2003 | Cernocky et al. |
| 2004/0238167 | A1 | 12/2004 | Pinto et al. |
| 2008/0103948 | A1 | 5/2008 | Schimdt et al. |
| 2008/0202325 | A1 | 8/2008 | Bertoja et al. |
| 2009/0084535 | A1 | 4/2009 | Bertoja et al. |
| 2009/0223400 | A1 | 9/2009 | Hill et al. |
| 2009/0301723 | A1 | 12/2009 | Gray |
| 2010/0051440 | A1 | 3/2010 | Hurst |
| 2012/0037365 | A1 | 2/2012 | Torres et al. |
| 2012/0199352 | A1 | 8/2012 | Lanclos et al. |
| 2012/0247769 | A1 | 10/2012 | Schacherer et al. |
| 2012/0250208 | A1 | 10/2012 | Love et al. |
| 2012/0255842 | A1 | 10/2012 | Runkel |
| 2012/0298361 | A1 | 11/2012 | Sampson |
| 2013/0043074 | A1 | 2/2013 | Tassaroli |
| 2013/0133889 | A1 | 5/2013 | Schacherer et al. |
| 2015/0000509 | A1 | 1/2015 | Current et al. |
| 2015/0226057 | A1 | 8/2015 | Bonavides et al. |
| 2016/0084048 | A1 | 3/2016 | Harrigan et al. |
| 2016/0245054 | A1 | 8/2016 | Hardesty et al. |
| 2016/0245056 | A1 | 8/2016 | Hardesty et al. |
| 2016/0245057 | A1 | 8/2016 | Hardesty |
| 2016/0245058 | A1 | 8/2016 | Hardesty et al. |
| 2016/0333676 | A1 | 11/2016 | Hardesty |
| 2017/0030167 | A1 | 2/2017 | Hardesty |
| 2019/0360315 | A1 * | 11/2019 | Hardesty ..... F42D 1/06 |

OTHER PUBLICATIONS

Office Action, dated Jun. 2, 2015, from corresponding/related U.S. Appl. No. 14/627,872.
Office Action, dated Mar. 8, 2017, from corresponding/related U.S. Appl. No. 15/293,069.
Office Action, dated Mar. 91, 2018, in corresponding/related U.S. Appl. No. 15/831,054.
Office Action, dated May 3, 2016, from corresponding/related U.S. Appl. No. 14/887,067.
Office Action, dated Nov. 2, 2016, from corresponding/related U.S. Appl. No. 14/887,067.

* cited by examiner

Prior Art

*Prior Art*

*Prior Art*

WELLBORE GUN PERFORATING SYSTEM AND METHOD

CROSS REFERENCE TO RELATED APPLICATIONS

This application is a continuation of U.S. application Ser. No. 15/293,069, filed Oct. 13, 2016, which is a continuation of application Ser. No. 14/887,067, filed Oct. 19, 2015, which is a continuation of U.S. application Ser. No. 14/627,872, filed Feb. 20, 2015, now U.S. Pat. No. 9,194,219, the disclosures of which are fully incorporated herein by reference.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to oil and gas extraction. Specifically, the invention attempts to pre-wire and connect plural perforating guns to pre-wired switch subs without manual wiring and connections.

PRIOR ART AND BACKGROUND OF THE INVENTION

Prior Art Background

The process of extracting oil and gas typically consists of operations that include preparation, drilling, completion, production and abandonment.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

A special tool, called a perforating gun, is lowered to the rock layer. This perforating gun is then fired, creating holes through the casing and the cement and into the targeted rock. These perforating holes connect the rock holding the oil and gas and the well bore.

The perforating gun consists of four components, a conveyance for the shaped charge such as a hollow carrier (charge holder tube), the individual shaped charge, the detonator cord, and the detonator. A shaped charge perforating gun detonates almost instantaneously when the electrical charge is sent from the perforating truck. The detonation creates a jet that has a velocity of 25,000 to 30,000 ft/second. The impact pressure caused by the jet is approximately 10 to 15 million psi.

In a detonation train there is a detonator/transfer, detonating cord and energetic device (shaped charge/propellant). The shaped charges are sequentially detonated by the denoting cord from one end to other end of the perforating gun. The shaped charges perforate through scalps on the outside of the perforating gun so that the burr created is on the inside and not on the outside of the gun.

A gun string assembly is a system with cascaded guns that are connected to each other by tandems. Inside a tandem, a transfer happens between the detonating cords to detonate the next gun in the daisy chained gun string. Detonation can be initiated from the wireline used to deploy the gun string assembly electrically, pressure activated or electronic means.

In tandem systems there is a single detonating cord passing through the guns. There are no pressure barriers. However, in select fire systems (SFS) there is a pressure isolation switch between each gun. Each gun is selectively fired though its own detonation train. A detonator feeds off each switch. When the lowermost perforating gun is perforated, pressure enters the inside of the gun. When the first gun is actuated, the second detonator gets armed when the pressure in the first gun switch moves into the next position, actuating a firing pin to enable detonation in the next gun.

Prior Art System Overview (0100)

As generally seen in the system diagram of FIG. 1 (0100), prior art systems associated with perforation gun assemblies include a wellbore casing (0101) laterally drilled into a wellbore. A gun string assembly (GSA) comprising a detonation train is positioned in a fracturing zone. The detonation train includes a detonator/transfer, detonating cord, and energetic device (shaped charge/propellant). The shaped charges are sequentially detonated by the detonating cord from one end to the other end of the perforating gun. The shaped charges perforate through scallops on the outside of the perforating gun. The detonation cord is actuated though the detonator from the firing head in the downstream gun (0102). The switch (0104) attached to the downstream gun (0102) is enabled electronically or by pressure when the downstream gun (0102) is fired from the surface through an electric signal in the through wire. Subsequently, the upstream perforating gun (0103) is fired when switch (0104) is enabled. The steps are repeated until all the stages in the perforating zone are completely perforated. There is a manual process involved in the assembly of the switch (0104) to perforating gun (0102) and perforating gun (0103). There is potential for error during any part of the assembly process. Therefore, there is a more reliable connection mechanism needed to perforate hydrocarbon formations with a gun string assembly.

Prior Art Perforating Gun—Sub Assembly (0200)

As generally seen in the system diagram of FIG. 2 (0200), prior art systems associated with perforation gun assemblies include a wellbore casing laterally drilled into a wellbore. A gun string assembly (GSA) comprising a detonation train is positioned in a fracturing zone. The detonation train includes a detonator/transfer (0209), detonating cord and energetic device (shaped charge/propellant). Plural perforating guns (0202, 0201) are connected by a switch sub (0203). The GSA is pumped into the wellbore casing with a wireline cable that has a conducting through wire (0207). The switch sub (0203) has a switch (0206) that connects a through line (0211) to an input/fire line (0204) of a detonator (0209) when enabled. The other input to the detonator is a ground line (0205) that is grounded to the switch sub body. The ground line may also be provided through a nut screwed to the switch sub (0203). The electrical connections inside the switch sub are made in the field of operations as described by the prior art method in FIG. 3 (0300). For example, the input connections to detonator (0211, 0205) are made manually at the job location. The wires are cut and packed into a sub port manually, which has potential for failure. Therefore, there is a need for a pre-wired perforating gun and switch sub system that does not require manual wiring connections.

Prior Art Assembly Method Overview (0300)

As generally seen in the method of FIG. 3 (0300), prior art switch connection method associated with assembling a guns string assembly as aforementioned in FIG. 1 (0100), comprise the steps of:

(1) Measuring and cutting the detonating cord (0301); The detonating cord from the perforating gun is measured and cut to the right size manually. There is a potential that the detonating cord is not cut to the correct size and a potential for an open connection. Therefore, there is a need for eliminating manual connections.

(2) Bring the ground wire and through wire out of a perforating gun (0302);

The ground used in a pressure switch connection is the sub body and may not function as desired. Therefore, there is a need to provide a reliable ground wire for the detonation to function as desired. This is especially true for electronic switches.

(3) Making electrical connections (0303);

The connections are made manually in the field and may cause undesired shorts or opens. There is a potential for missing one gun in the assembly, in which case the whole gun string assembly has to be pulled out.

(4) Installing the switch (0304);

(5) Sorting, crimping and cutting the wires (0305); There is a potential for failure in the process.

(6) Coiling and packing the wires into the sub through the sub port (0306); and Once the detonator is armed, any voltage source to the detonator can cause the gun to misfire. Therefore, there is a need for a safer perforating gun system with minimal manual steps.

(7) Inspecting the wiring and closing the sub port (0307).

As all the above mentioned steps are performed manually at the oil rig field, there is a potential for error at any one of the above mentioned steps. Therefore, a connection mechanism with no manual connection steps is needed for a reliable perforation system.

Prior Art Perforation Method Overview (0400)

As generally seen in the method of FIG. 4 (0400), prior art perforation method associated with a prior art gun string assembly as aforementioned in FIG. 1 (0100) comprises the steps of:

(1) Making electrical connections and arming detonators in a gun string assembly (0401);

The electrical connections are described above in flowchart (0300).

(2) Deploying gun string assembly into a wellbore casing (0402);

(3) Isolating a perforating stage (0403);

(4) Firing a gun located at the downstream end (downstream gun) with a trigger signal in the through line (0404);

(5) Activating a switch in a sub attached to the next gun located upstream and electrically disconnect the fired downstream gun (0405); and (6) Pulling the GSA upstream with the switch activated and fire the gun located upstream (0406);

(7) Checking whether all perforation stages have been completed, if not, proceeding to step (0404) (0407; and (8) Pulling the GSA out of the wellbore casing and prepare for the next isolated stage (0408).

Deficiencies in the Prior Art

The prior art as detailed above suffers from certain deficiencies. For example, prior art systems do not provide for reliable connection mechanism needed to perforate hydrocarbon formations with a gun string assembly. Prior art systems also do not provide for a pre-wired perforating gun and switch sub system that does not require manual wiring connections. Prior art systems do not provide for a connection mechanism with no manual connection steps. Prior art systems do not provide for a reliable ground wire for the detonator in a perforating gun system for the detonation to function as desired.

While some of the prior art may teach some solutions to several of these problems, the core issue of reacting to unsafe gun pressure has not been addressed by prior art.

OBJECTIVES OF THE INVENTION

Accordingly, the objectives of the present invention are (among others) to circumvent the deficiencies in the prior art and affect the following objectives, which includes providing for a reliable connection mechanism needed to perforate hydrocarbon formations with a gun string assembly; providing for a pre-wired perforating gun and switch sub system that does not require manual wiring connections; providing for a connection mechanism with no manual connection steps; and providing for a reliable ground wire for the detonator in a perforating gun system for the detonation to function as desired.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The present invention provides a system that includes a gun string assembly (GSA) deployed in a wellbore with plural perforating guns attached to plural switch subs. The perforating guns are pre-wired with a multi conductor single cable that is connected to electrical contacts or rings on either end of the perforating guns. The switch subs are configured with electrical contacts that are screwed into the electrical contacts of the perforating guns without the need for manual electrical connections and assembly in the field of operations. The system further includes a detonator that is positioned upstream of the perforating gun. The detonator is wired to a switch that is positioned downstream of the perforating gun.

Method Overview

The present invention system may be utilized in the context of an overall gas extraction method, wherein the wellbore gun perforating system described previously is controlled by a method having the following steps:

(1) attaching the wired switch sub to the first wired perforating gun in a gun string assembly;
(2) repeating the step (1) until desired number of wired perforating guns are attached to wired switch subs in the gun string assembly;
(3) deploying the gun string assembly into the wellbore casing with a wireline comprising the first cable;
(4) isolating a perforating stage in the wellbore casing;
(5) firing the first wired perforating gun that is positioned at a downstream end of the wellbore casing with a trigger signal in one of the plurality of first conducting wires in the first cable;
(6) activating a switch in the wired switch sub and electrically disconnecting the first wired perforating gun;
(7) pulling the gun string assembly upstream with the switch activated and firing the second wired perforating gun with a detonator positioned upstream of the second wired perforating gun;
(8) checking whether all perforation stages have been completed, if not, proceeding to the step (5); and
(9) pulling the gun string assembly out of the wellbore casing and preparing for the next isolated stage.

Integration of this and other preferred exemplary embodiment methods in conjunction with a variety of preferred exemplary embodiment systems are described herein in anticipation of the overall scope of the present invention.

BRIEF DESCRIPTION OF THE DRAWINGS

For a fuller understanding of the advantages provided by the invention, reference should be made to the following detailed description, together with the accompanying drawings, wherein.

DESCRIPTION OF THE PRESENTLY PREFERRED EXEMPLARY EMBODIMENTS

Figure 1:
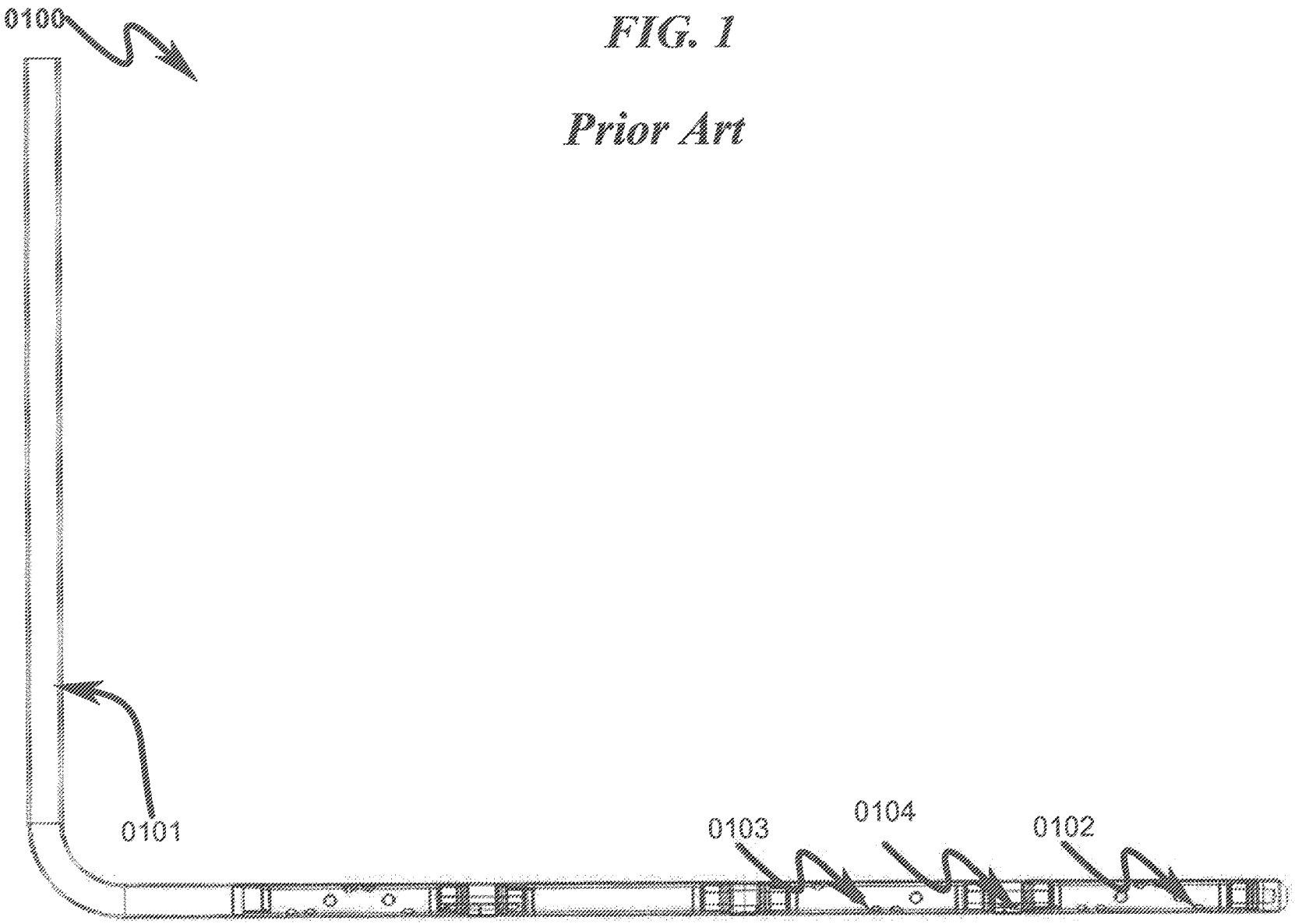
FIG. 1 Prior Art
FIG. 1 illustrates a system block overview diagram for how prior art systems use gun string assemblies to perforate isolated fracturing zones.
Figure 2:
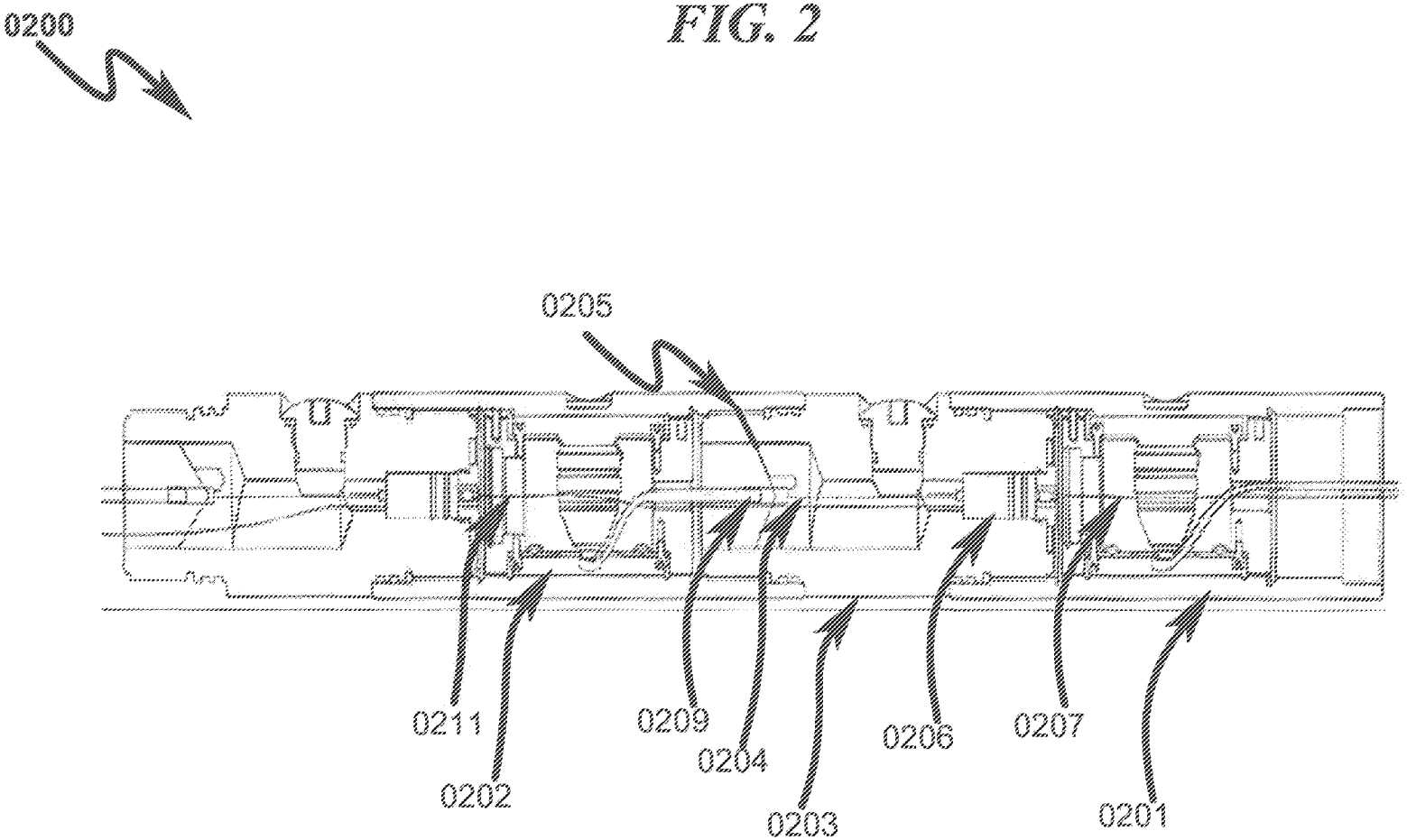
FIG. 2 illustrates a prior art perforating gun assembly with switch subs.
Figure 3:
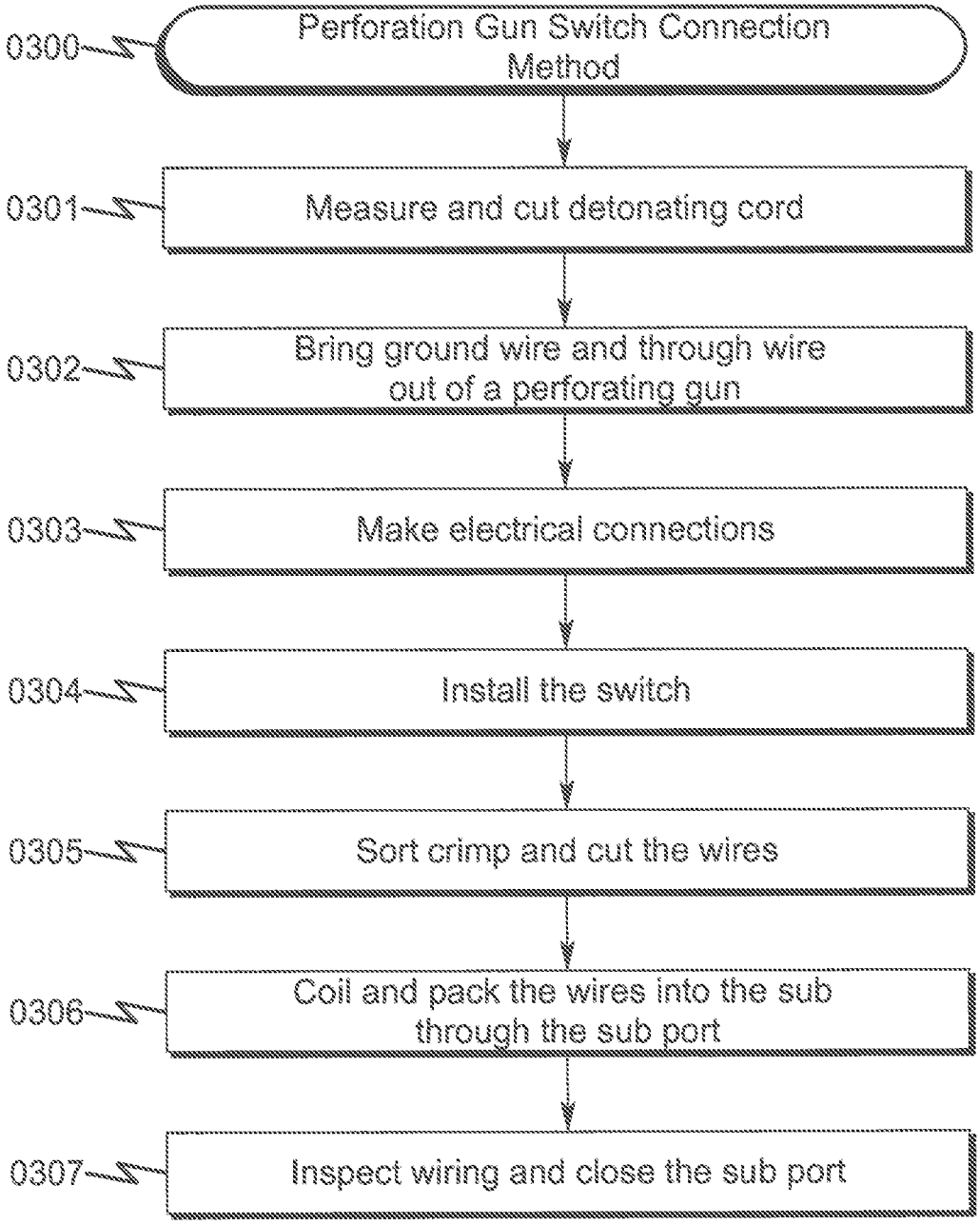
FIG. 3 illustrates a flowchart describing how prior art systems assemble perforating guns with switch subs.
Figure 4:
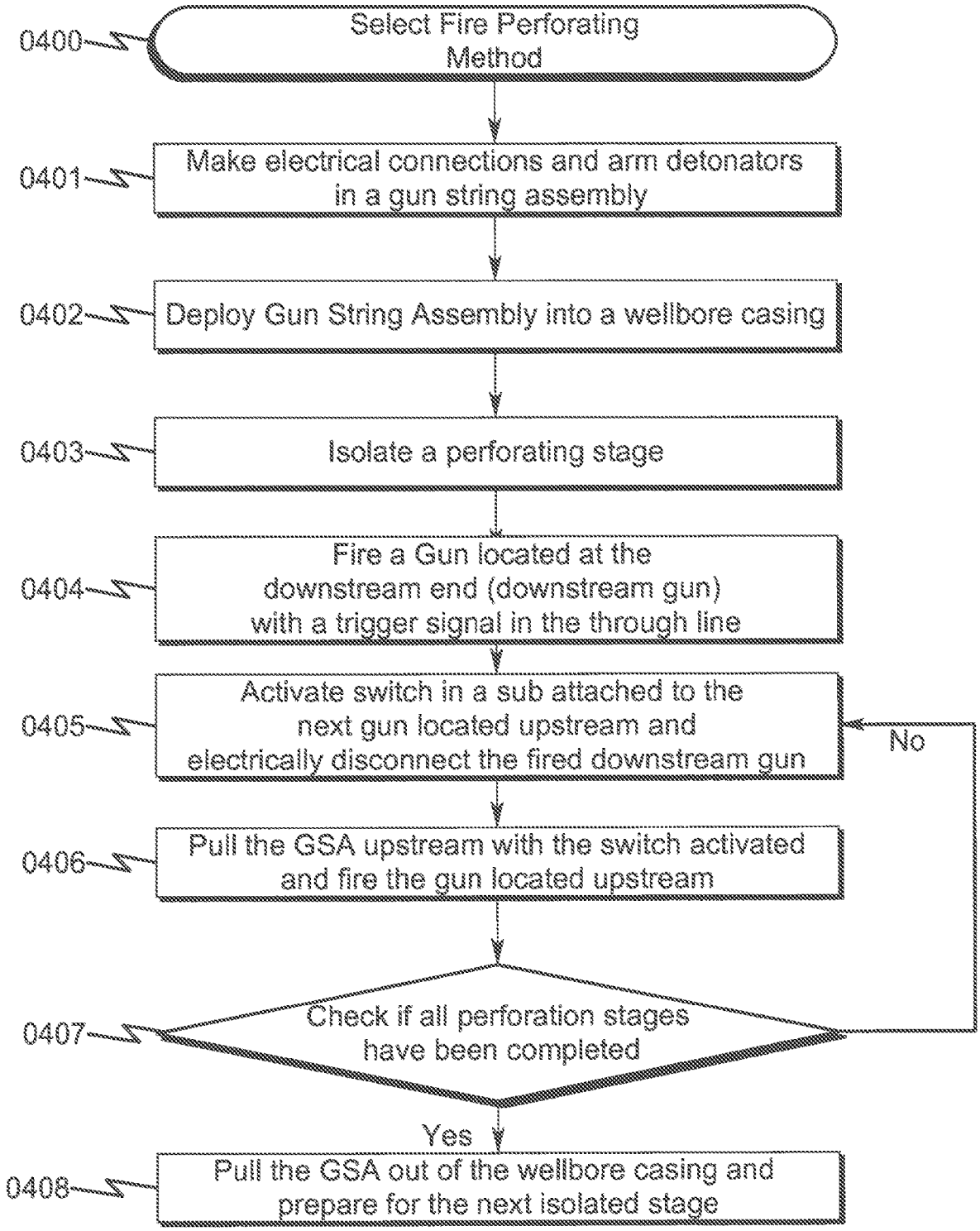
FIG. 4 illustrates a flowchart describing how prior art systems perforate hydrocarbon formations with perforating guns and switch subs.

While this invention is susceptible to embodiment in many different forms, there are shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The numerous innovative teachings of the present application will be described, with particular reference to the presently preferred embodiment, wherein these innovative teachings are advantageously applied to the particular problems of a wellbore gun perforating system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features, but not to others.

It should be noted that the term "downstream" is used to indicate a position that is closer to the toe end of the wellbore casing, and term "upstream" is used to indicate a position that is closer to the heel end of the wellbore casing. The term "fire wire" or "arming wire" is used to indicate an input that is electrically connected to a detonator. The term "through wire" is used to indicate a conducting electrical wire that is part of a wireline cable that is connected to a gun string assembly. The term "actuate" or "arming" or "activate" is used to indicate the connection of a through wire to a fire wire that is connected to a detonator. The term "ground wire" is used to indicate an electrical ground. The term "firing a detonator or perforating gun" is used to indicate an event when an electrical signal is transmitted through a through wire to the fire wire of a detonator.

Preferred Embodiment System Wired Perforating Gun (0500)

Figures 5, 5A:
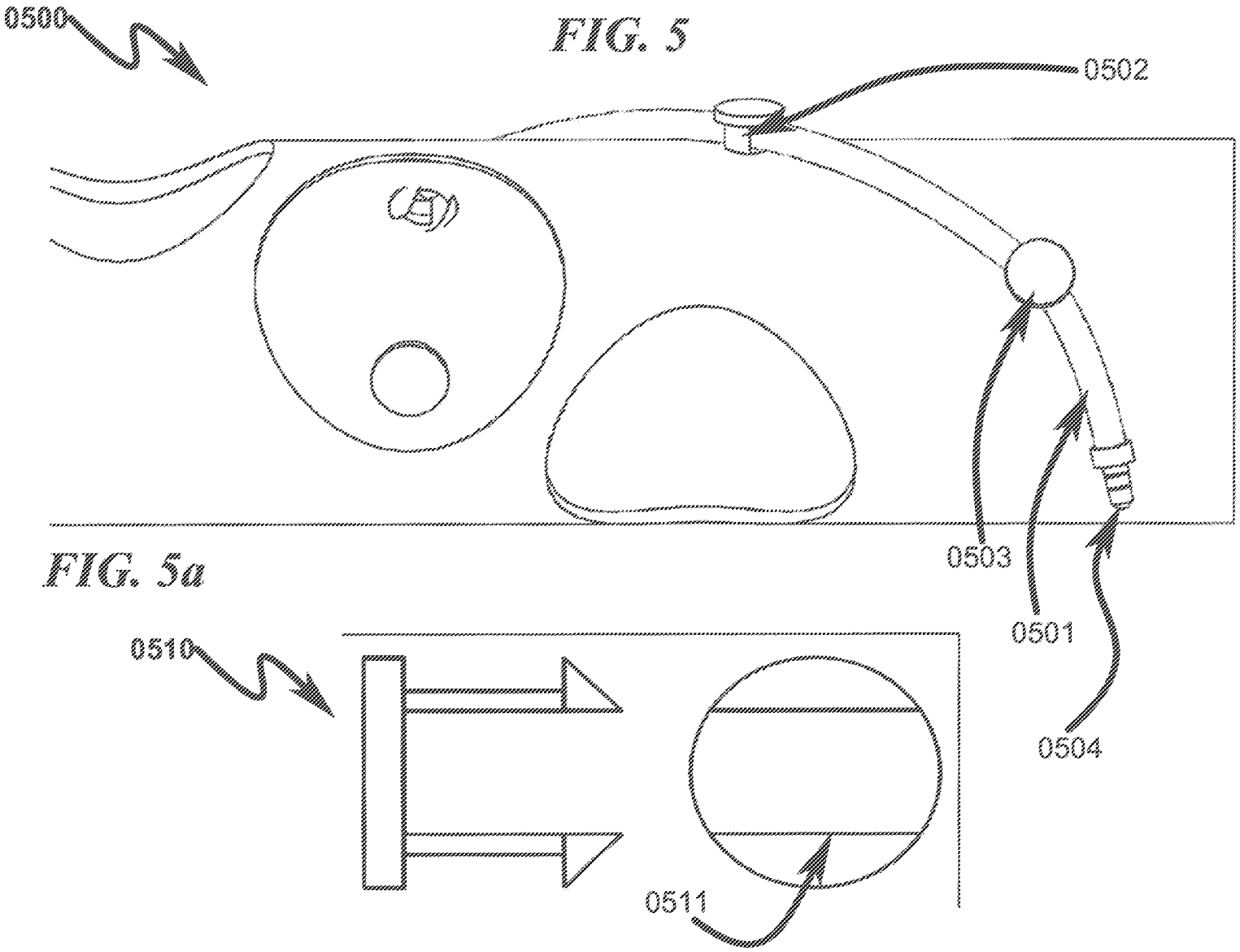
FIG. 5 illustrates an exemplary front cross section of a pre-wired perforating gun with a multi conductor single cable according to a preferred embodiment of the present invention.
FIG. 5*a* illustrates an exemplary clip to hold a multi conductor single cable according to a preferred embodiment of the present invention.
Figure 6:
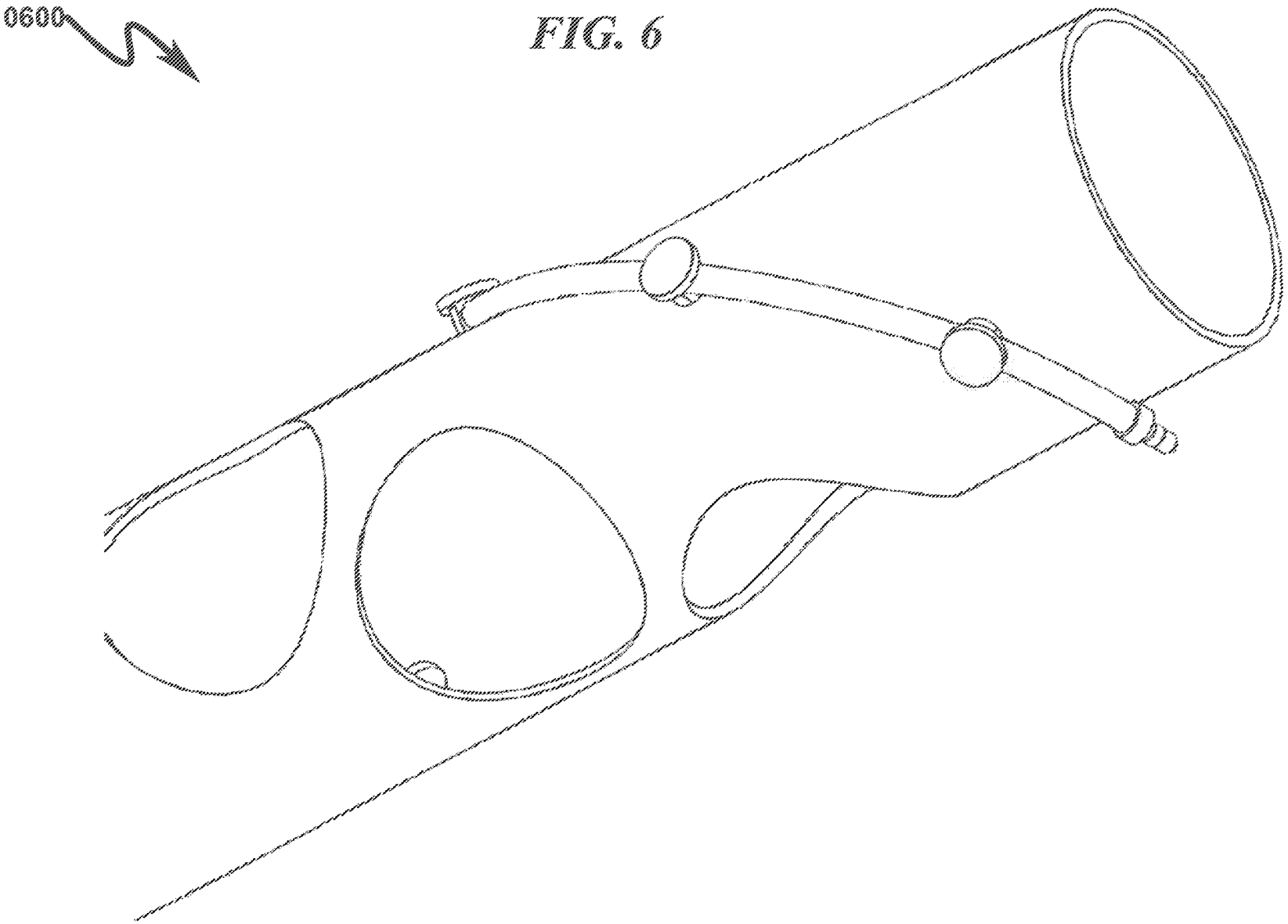
FIG. 6 illustrates an exemplary perspective view of a pre-wired perforating gun with a multi conductor single cable according to a preferred embodiment of the present invention.

The present invention may be seen in more detail as generally illustrated in FIG. 5 (0500), wherein a perforating gun (0500) is pre-wired with a cable (0501) through pre finished holes (0503) drilled into the body of the perforating gun (0500). According to a preferred exemplary embodiment, the holes are machined in the perforating gun (0500) at pre-determined points that are best suited to allow the cable to pass through without causing stress on the perforating gun. The holes may be machined in a helical manner. The holes may be circular, elliptical, or square shaped. According to a preferred exemplary embodiment, the cable may be held by clips (0502) or other fastening means. According to a preferred exemplary embodiment, the cable may pass through clips or other routing means. According to another preferred exemplary embodiment, the cable comprises at least two conducting wires. The cable may be routed on the inside of the charge holder tube or on the outside of the charge holder tube. A cross section and a front view of the fastening means (0511) is detailed in FIG. 5*a* (0510). According to a preferred exemplary embodiment, the cable comprises multiple conductors with a single pin (0504). According to yet another preferred exemplary embodiment, the cable may comprise a through conducting wire and a ground conducting wire. According to a most preferred exemplary embodiment, the cable comprises a through conducting wire, a ground conducting wire, and a firing wire. According to a further preferred exemplary embodiment, the cable comprises a through conducting wire, a ground conducting wire, a communication wire, and a firing wire. According to a most preferred exemplary embodiment, the cable may comprise a through conducting wire. The cable may be part of the wireline that is used to pump down a gun string assembly. The through line is a conductor in the cable that is capable of handling high voltages transmitted from the surface of the oil rig. The through wire may be used to send a voltage signal to an armed detonator to initiate detonation in a detonation train in a perforating gun. The firing wire may be a conductor that may be used to connect to a detonator input from a switch output. The ground line may be part of the wireline for providing a reliable ground to electronic or pressure switches. According to a preferred exemplary embodiment, the communication wire may be part of the wireline and may be used to electronically transmit status information to the surface. For example, a perforating gun's faulty connection may be transmitted via the communication wire to the surface or an operator. According to another preferred exemplary embodiment, the communication wire may be part of the wireline and may be used to electronically receive instructions from the surface. For example, a perforating gun in the gun string assembly may be skipped or disabled by transmitting an instruction from the surface of the oil rig via the communication wire. In another example, an instruction may be transmitted via the communication wire to introduce a delay into the switch for initiating a perforating event at a set time delay. According to a yet another preferred exemplary embodiment, pre-wiring a perforating gun with plural conducting wires eliminates the need to manually cut, crimp, pack, or inspect wires in the field of operations. FIG. 6 (0600) illustrates a perspective view of a wired perforating gun.

Preferred Embodiment System Integrated Perforating Gun Switch Sub Assembly (0700)

Figure 7:
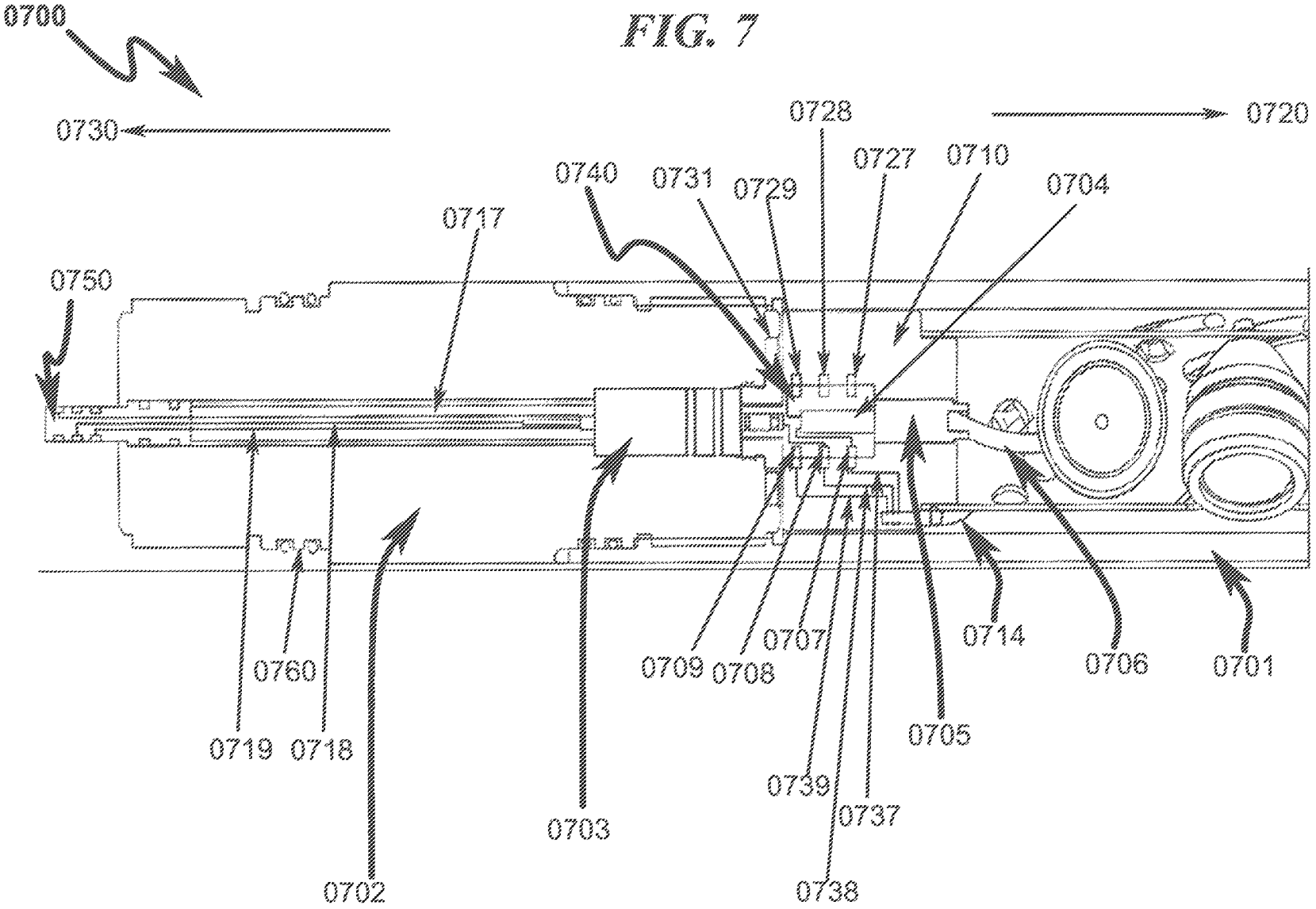
FIG. 7 illustrates a front section view of a pre-wired perforating gun with electrical contacts integrated to a switch sub with electrical contacts, depicting a preferred embodiment of the present invention.
Figure 8:
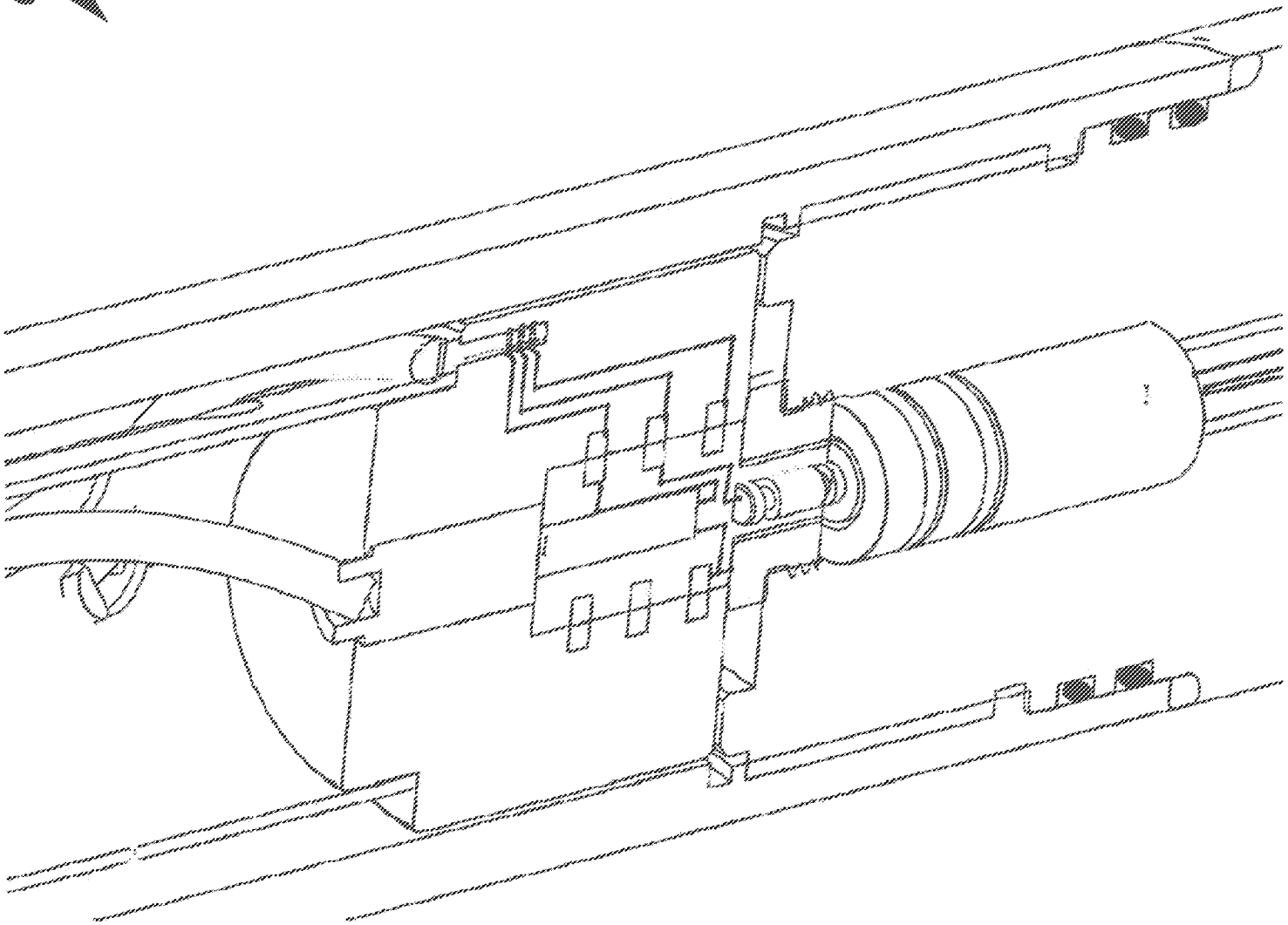
FIG. 8 illustrates a perspective view of a pre-wired perforating gun with electrical contacts integrated to a switch sub with electrical contacts, depicting a preferred embodiment of the present invention.

The present invention may be seen in more detail as generally illustrated in FIG. 7 (0700), wherein a front section view of a pre-wired perforating gun (0701) with electrical contacts (0727, 0728, 0729) integrated to a switch sub (0702) with electrical contacts (0707, 0708, 0709) is shown. A perspective view is illustrated in FIG. 8 (0800). It should be noted that the term "downstream" (0720) is used to indicate a position that is closer to the toe end of the wellbore casing, and the term "upstream" (0730) is used to indicate a position that is closer to the heel end of the wellbore casing. The switch is part of the switch sub. The switch sub (0702) may comprise an upstream adapter (0750) at an upstream end and a downstream adapter (0740) at a downstream end. The size of the upstream adapter (0750) may be different than the downstream adapter as it enables the switch sub (0702) to be assembled in one direction only. A cable (0714) passing through a charge holder tube in the perforating gun (0701) comprises plural conducting wires. As illustrated in the figure, the cable may comprise a through wire (0738) connected to an electrical contact (0728), a fire/power wire (0737) connected to an electrical contact (0727), and a ground wire (0739) connected to an electrical contact (0729). According to a preferred exemplary embodiment, the electrical contacts (0727, 0728, 0729) may be electrical contact rings. The cable (0714) in the perforating gun (0701) may further be electrically connected at a connection point at a manufacturing facility. The cable may be routed through clips in a charge holder tube to prevent slack and twisting as illustrated in FIG. 5 (0500).

The switch sub (0702) may comprise an adapter configured with electrical contacts. The electrical contacts may be a through wire contact (0708), a ground contact (0709) and a fire/power contact (0707). The adapter may be a hollow member that can accept a switch (0703) that is connected to a detonator (0704) through a retaining member (0731). According to a preferred exemplary embodiment, the switch may be a pressure switch. Pressure switches are conventionally used in perforating gun systems wherein a pressure acted upon a piston in the switch enables a connection between a through wire and a fire wire which is in turn connected to a detonator. According to a preferred exemplary embodiment, the switch may be an electronic switch. According to another preferred exemplary embodiment, the switch is configured with a pre-determined electronic time delay. For example, the switch may be programmed with a delay such that a firing event in a perforating gun activates a timer in the next switch. The switch may then be actuated when the timer expired. Subsequently, another timer in an upstream switch may be initiated and, upon expiration of the timer, the upstream switch may be armed without the need for actuation forces to actuate the switch. According to a preferred exemplary embodiment, the switch is actuated by the pre-determined time delay or actuation forces, or a combination thereof. The pre-determined electronic time delay may be programmed to 1 minute. The pre-determined electronic time delay may be programmed in the range of 10 seconds to 10 minutes. The output of the switch may be 3 conducting wires, a ground wire (0719), a through wire (0718), and a power wire (0717). According to yet another preferred exemplary embodiment, the switch is configured with a pre-determined ballistic time delay. For example, the switch may be programmed with a ballistic delay such that a firing event in a perforating gun with a detonator activates a timer in a switch attached to the detonator without the need for actuation forces from a perforation gun or wellbore pressure. The ballistic time delay is the time required to burn the length of a ballistic wire connected to the detonator. The length of the ballistic wire may be customized to achieve the desired time for the ballistic time delay. For example, a length of 10 inches might provide a ballistic time delay of 1 minute. Plural detonating members may be strung together to achieve the desired ballistic time delay. For example, one detonating member may result in a 6 minute delay, 2 detonating members in series may produce a 12 minute delay, and so on. The output of the switch may be connected to the other end of the switch sub to electrical contacts in an adapter. The connections between the adapters at both ends of the switch may be solid conducting rods or conducting wires.

According to a preferred exemplary embodiment, the pre wired switch sub (0702) is screwed/attached into the pre wired perforating gun (0701) so that the electrical contacts in the perforating gun are connected to electrical contacts in the switch sub respectively. The electrical contacts may be machined in the end plate (0710) of the perforating gun. When the perforating gun (0701) is fired the detonator receives a signal from the surface, which then initiates a detonating or ballistic event. The ballistic event is transferred via an aligned bidi transfer (0705) to a detonating cord (0706). Plural shaped charges that are attached to the detonating cord carry out the perforation into a hydrocarbon formation.

According to a further exemplary embodiment, when the perforating gun (0701) is fired, the switch (0703) is activated, which then arms the detonator upstream of the switch sub (0703) by connecting the through wire (0718) to the fire/power line of the detonator upstream.

Preferred Embodiment System Electrical Diagram (0900)

Figure 9:
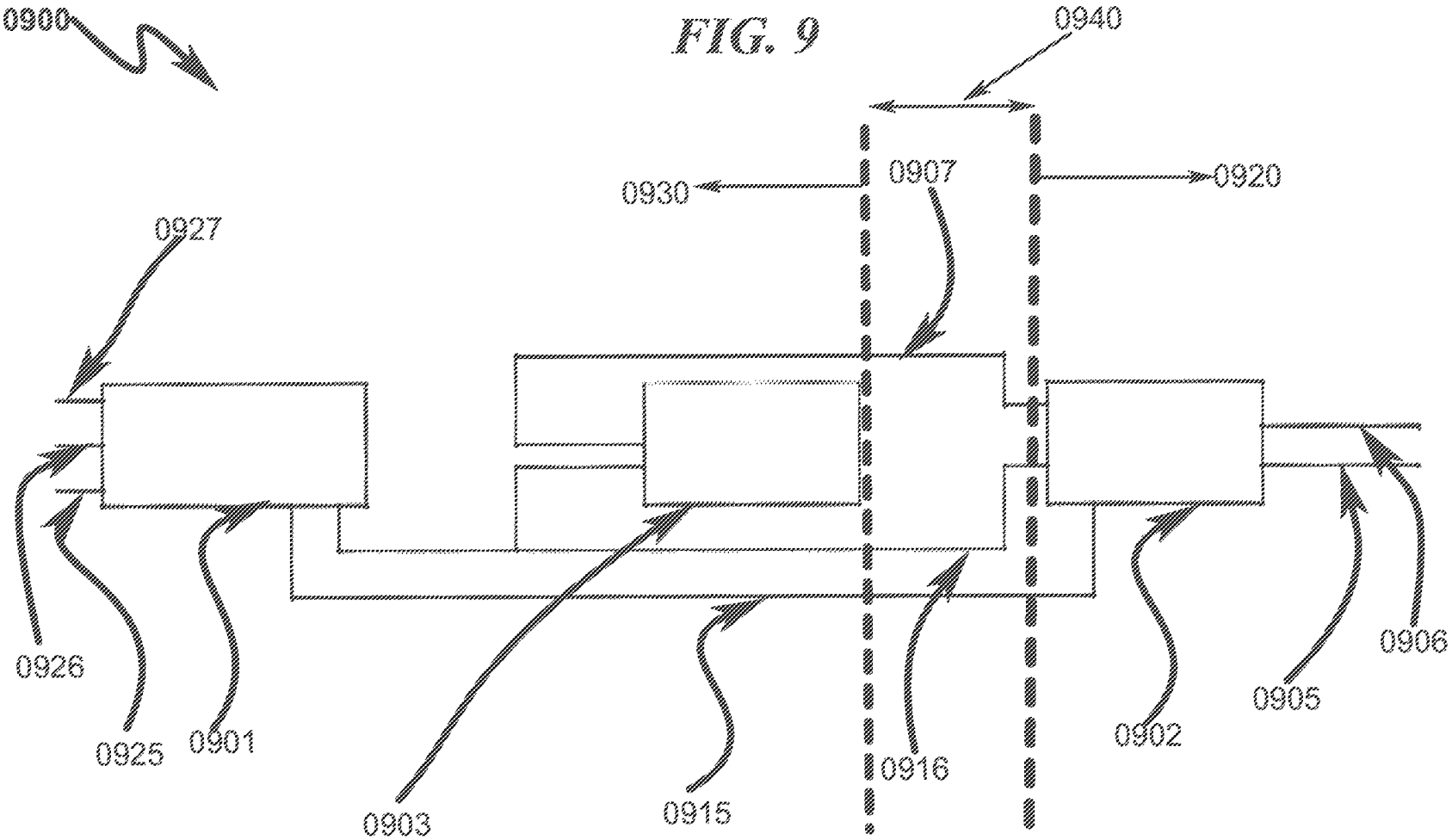
FIG. 9 illustrates an exemplary electrical connection diagram between a perforating gun, detonator and a switch sub depicting a preferred embodiment of the present invention.

The present invention may be seen in more detail as generally illustrated in FIG. 9 (0900), wherein an electrical connection diagram between a perforating gun, a detonator and a switch sub is shown. The perforating gun (0940) is connected to a switch sub (0920) at the gun's downstream end and to a switch sub (0930) at the gun's upstream end. It should be noted that the term "downstream" is used to indicate a position that is closer to the toe end of the wellbore casing, and the term "upstream" is used to indicate a position that is closer to the heel end of the wellbore casing. The term "fire wire" or "arming wire" is used to indicate an input that is electrically connected to a detonator. The term "through wire" is used to indicate a conducting electrical wire that is part of a wireline cable that is connected to a gun string assembly. The term "actuate" or "arming" is used to indicate the connection of a through wire to a fire wire that is connected to a detonator. The term "ground wire" is used to indicate an electrical ground. The term "firing a detonator or perforating gun" is used to indicate an event when an electrical signal is transmitted through a through wire to the fire wire of a detonator.

The switch is positioned in a switch sub. The electrical connection includes a switch (0902) electrically connected to a detonator (0903) that is positioned upstream of the switch (0902) and downstream of the switch (0901). The power/fire output (0907) of switch (0902) is connected to the input of the upstream detonator (0903). The ground output (0916) of switch (0902) is connected to the other input of the upstream detonator (0903) and also to the upstream switch (0901) through a cable in a perforating gun. The through wire output (0915) of the downstream switch (0902) is connected to the input of the upstream switch (0901) through a cable in a perforating gun. The inputs to the downstream switch (0902) are through wire (0905) and ground wire (0906), which are outputs from a switch downstream of switch (0902). The outputs of upstream switch (0901), through wire (0925), and ground wire (0926) are connected to the inputs of a switch positioned upstream of switch (0901). Similarly, fire wire (0927) is further connected to a detonator positioned upstream of switch (0901). When a perforating gun fires downstream of switch (0902), it enables switch (0902) i.e., connects the through wire (0905) to the fire wire (0907) whereby detonator (0903) is enabled. Similarly, when detonator (0903) is fired, it enables upstream switch (0901) by connecting the through wire (0925) to the fire/power wire (0927) that is connected to the input of an upstream detonator.

Preferred Exemplary Wellbore Perforating Gun Assembly Flowchart Embodiment (1000)

Figure 10:
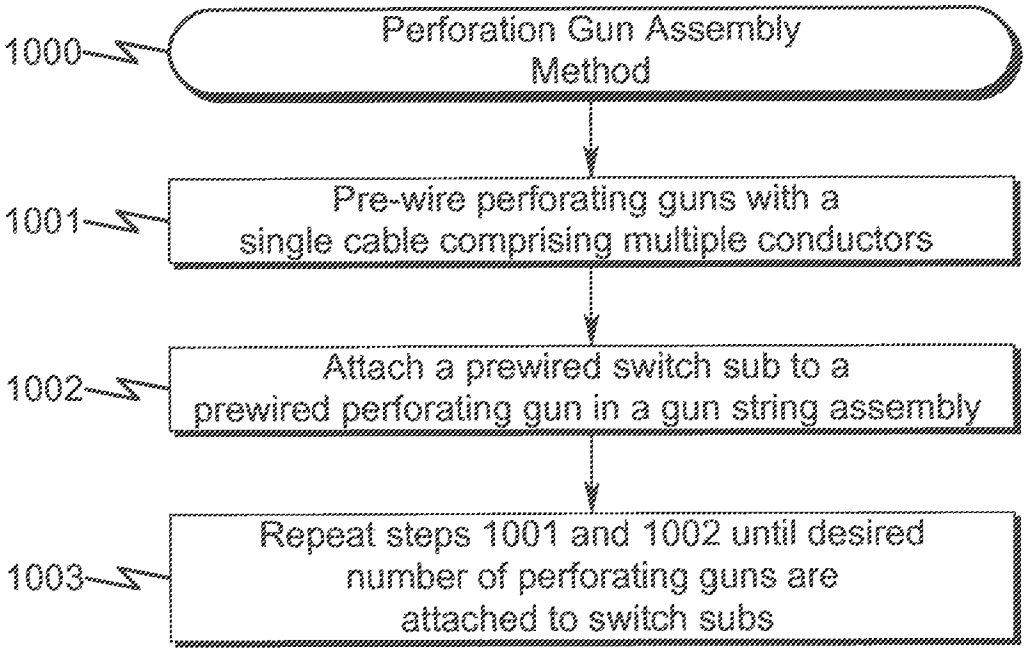
FIG. 10 illustrates an exemplary flowchart to assemble perforating guns with switch subs according to a presently preferred embodiment of the present invention.

As generally seen in the flow chart of FIG. 10 (1000), a preferred exemplary wellbore perforation gun assembly method may be generally described in terms of the following steps:

(1) pre-wiring perforating guns with a single cable comprising multiple conductors (1001);
As shown above in FIG. 5 (0500), a perforating gun may be prewired with a cable through the holes and clips in the perforating gun in a manufacturing facility.

(2) attaching a prewired switch sub to a prewired perforating gun in a gun string assembly (1002).
The perforating gun comprises secondary explosives (shaped charges) while the switch sub comprises primary detonation (detonator). According to a preferred exemplary embodiment, attaching a perforating gun comprising secondary explosives with a switch sub comprising primary explosives eliminates the need for manual connections in the field of operations.

(3) repeating steps (1001) and (1002) until all perforating guns are attached to switch subs (1003).
As shown above in FIG. 7 (0700), a switch sub may be screwed or attached to perforating guns at the upstream and downstream ends of the switch sub.

Preferred Exemplary Wellbore Perforating Gun Flowchart Embodiment (1100)

Figure 11:
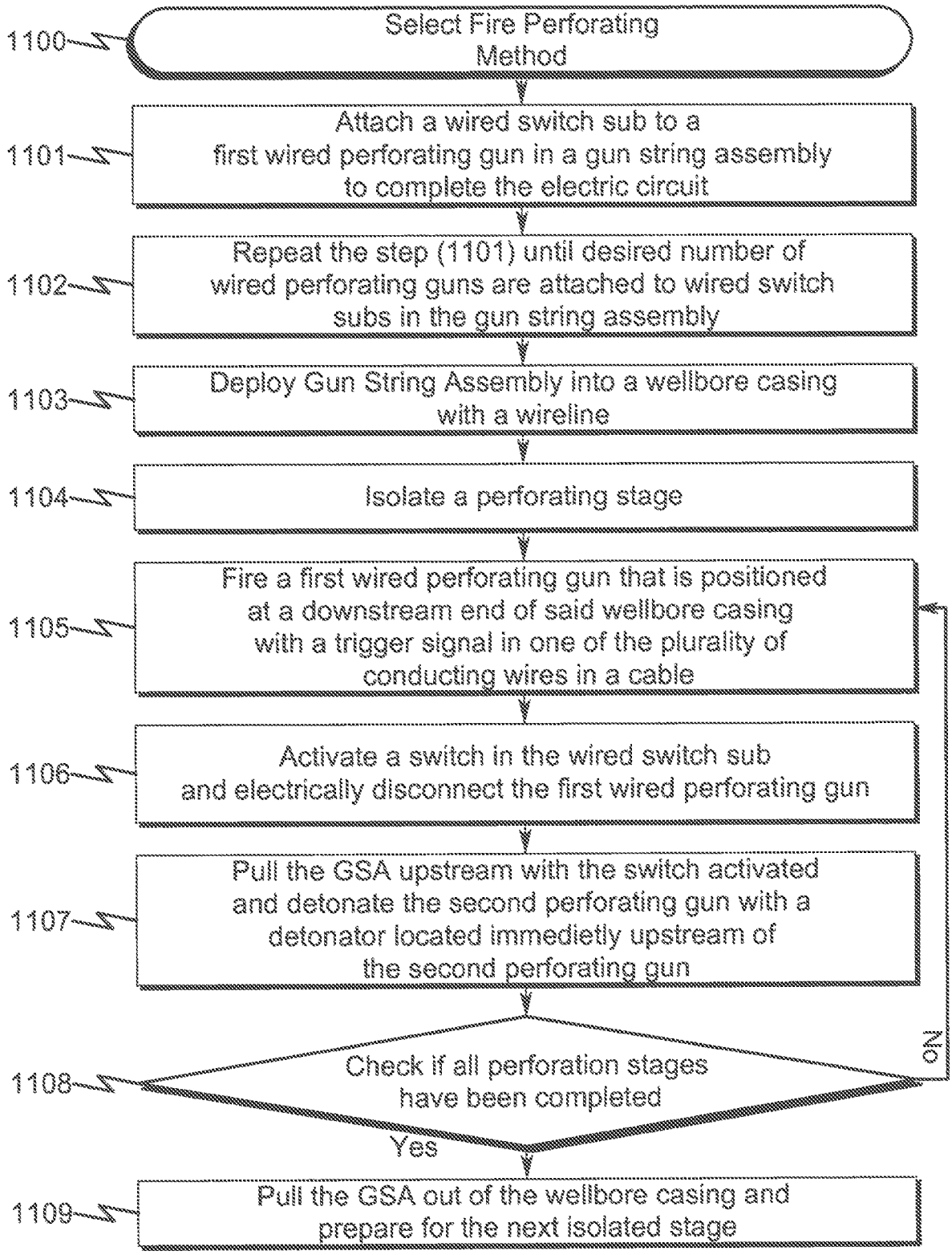
FIG. 11 illustrates a detailed flowchart of a wellbore perforation method according to a preferred exemplary invention embodiment.

As generally seen in the flow chart of FIG. 11 (1100), a preferred exemplary wellbore gun perforating method may be generally described in terms of the following steps:

(1) attaching the wired switch sub to the first wired perforating gun in a gun string assembly (1101);
(2) repeating the step (1101) until desired number of plural wired perforating guns are attached to plural wired switch subs in the gun string assembly (1102);
(3) deploying the gun string assembly into the wellbore casing with a wireline comprising the first cable (1103);
(4) isolating a perforating stage in the wellbore casing (1104);

(5) firing the first wired perforating gun that is positioned at a downstream end of the wellbore casing with a trigger signal in one of the plurality of first conducting wires in the first cable (1105);

For example, a downstream gun attached to switch (0902) may be fired as shown in FIG. 9 (0900). According to a preferred embodiment, the switch (0902) may be activated in step (1106) by an output of a detonator that is used to fire the downstream gun. When a detonator is fired, the blast travels away from the switch in the downstream direction of the perforating gun. This is in contrast to prior art switch activations, wherein pressure switches are primarily activated by the actuation force of the main explosive train (shaped charges) or wellbore pressure. According to a preferred exemplary embodiment, the pressure switch is activated by the blast created by primary explosives (detonator). This method of activating the pressure switch is reliable, repeatable, and reproducible as compared to unreliable switch activation methods taught in current prior art.

(6) activating a switch in the wired switch sub and electrically disconnecting the first wired perforating gun (1106);

The wired switch sub is connected to the first wired perforating gun at a downstream end of the switch sub and a second wired perforating gun that is connected to the upstream end of the switch sub; As illustrated in FIG. 9 (0900), the switch (0902) is activated when a downstream gun (GUN1) attached downstream to switch (0902) is fired. As described above in step (1105), the switch may be activated by the output of a detonator. GUN1 is electrically disconnected from the through wire after it is fired. The switch (0902) may be connected to GUN1 at a downstream end of the switch sub and to an upstream perforating gun (GUN2) at an upstream end of the switch sub. The GUN2 may be attached to another switch (0901) on its upstream end. Likewise, when GUN2 is fired, it activates switch (0901) and disconnects GUN2 electrically from the through wire. The process may continue until all the perforating guns in the gun string assembly are fired.

(7) pulling the gun string assembly upstream with the switch activated and firing a second wired perforating gun with a detonator positioned upstream of the second wired perforating gun (1107);

As shown in FIG. 9 (0900), when GUN2 is fired with the detonator (0903) that is positioned upstream of GUN2, it activates switch (0901) and disconnects GUN2 electrically from the through wire. The process may continue until all the perforating guns in the gun string assembly are fired.

(8) Checking whether all perforation stages have been completed, if not, proceeding to the step (1105) (1108); and (9) Pulling the gun string assembly out of the wellbore casing and preparing for the next isolated stage (1109).

Preferred Exemplary Wellbore Perforating Gun Sequence Flowchart Embodiment (1200)

Figure 12:
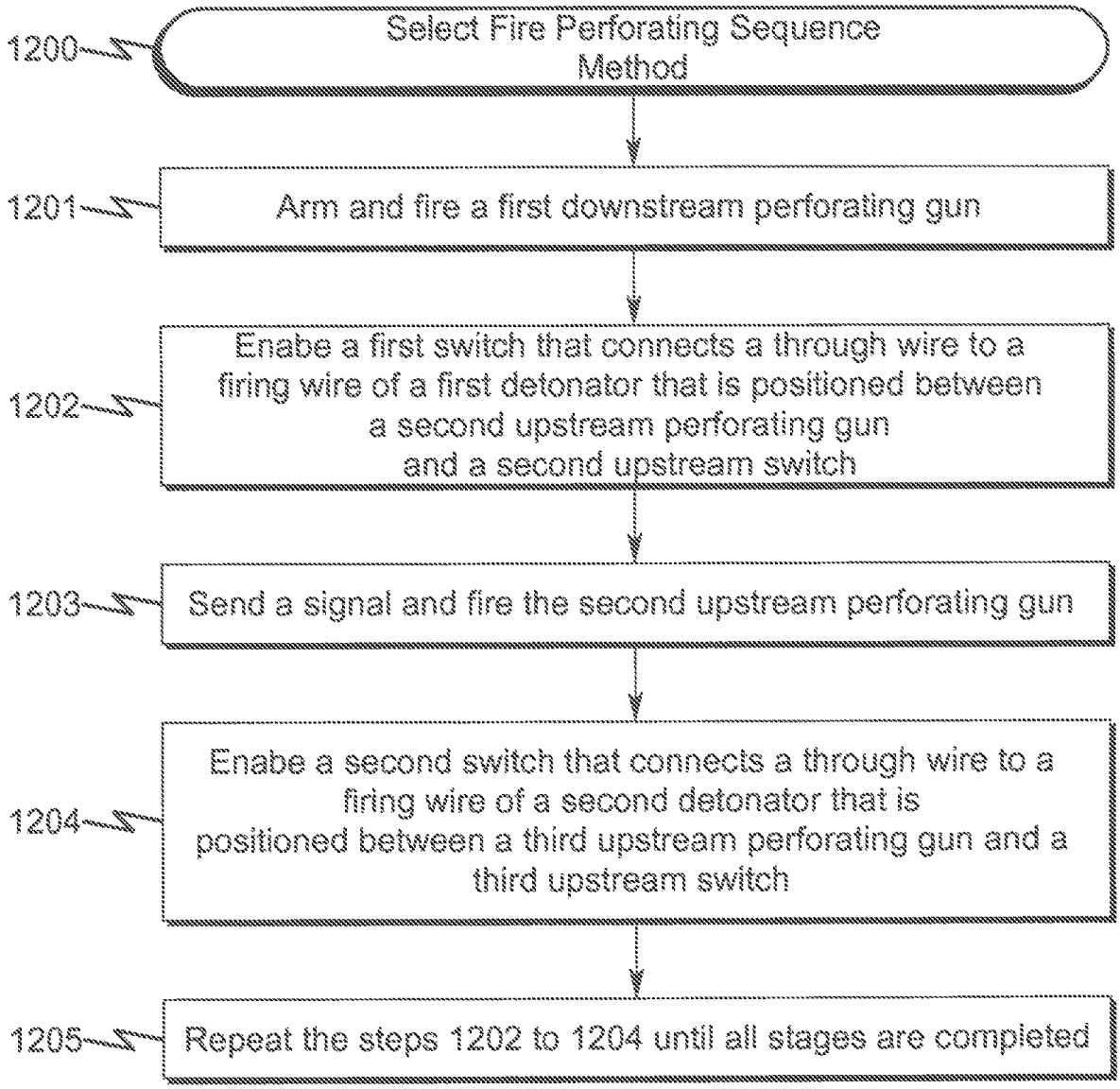
FIG. 12 illustrates a detailed flowchart of a wellbore perforation sequence method according to a preferred exemplary invention embodiment.

As generally seen in the flow chart of FIG. 12 (1200), a preferred exemplary wellbore gun perforating sequence method may be generally described in terms of the following steps:

(1) Arming and firing a first downstream perforating gun (1201);

(2) Enabling a first switch that connects a through wire to a firing wire of a first detonator that is positioned between a second upstream perforating gun and a second upstream switch (1202);

(3) Sending a signal and firing the second upstream perforating gun (1203);

(4) Enabling a second switch that connects a through wire to a firing wire of a second detonator that is positioned between a third upstream perforating gun and a third upstream switch (1204);

(5) Repeating steps (1202) to (1204) until all stages are completed in the fracturing zone (1205).

Preferred Embodiment System Switch Sub Embodiment (1300)

Figure 13:
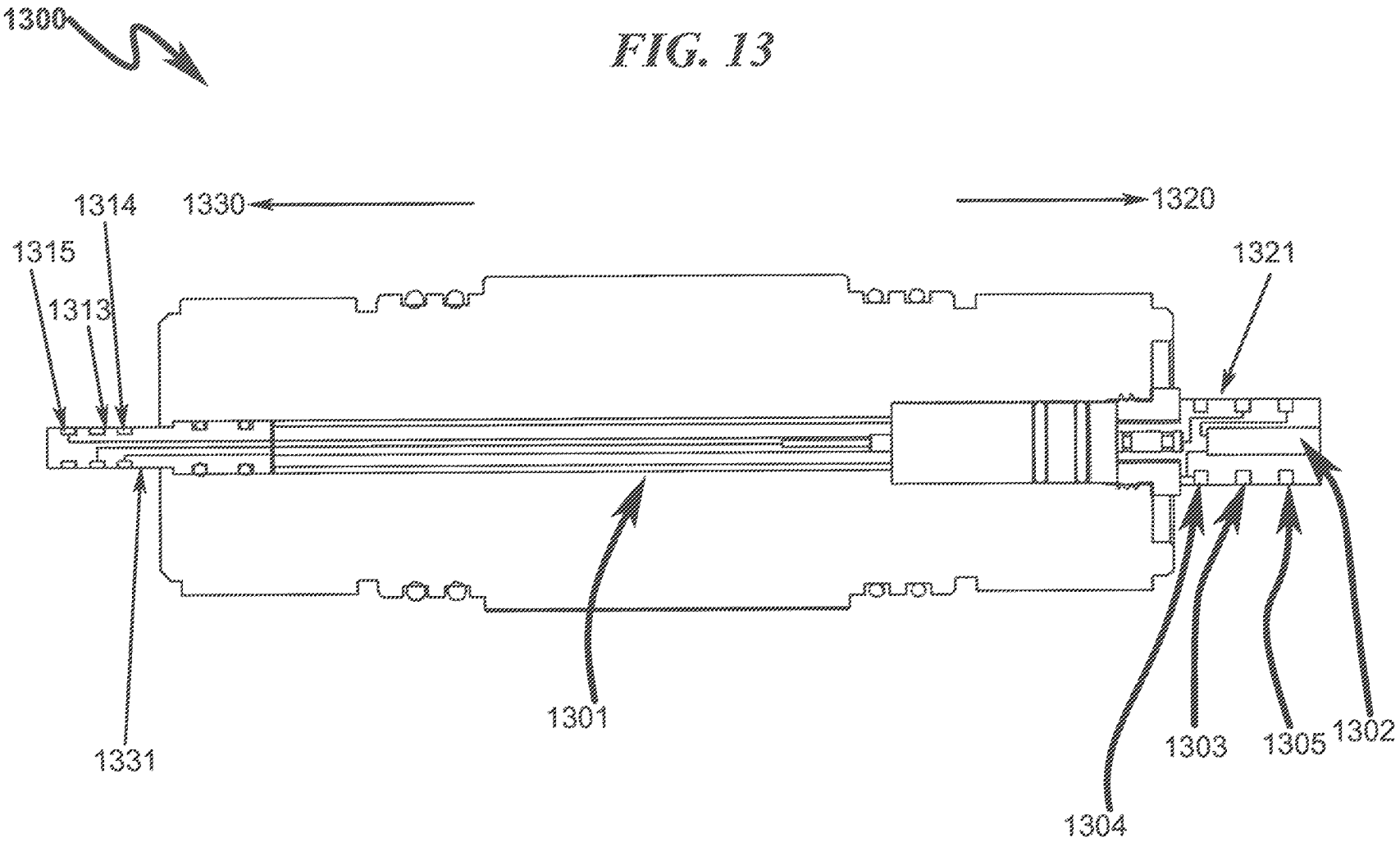
FIG. 13 illustrates an exemplary front section view of a 2 part switch sub with no port with a detonator depicting a presently preferred embodiment of the present invention.
Figure 14:
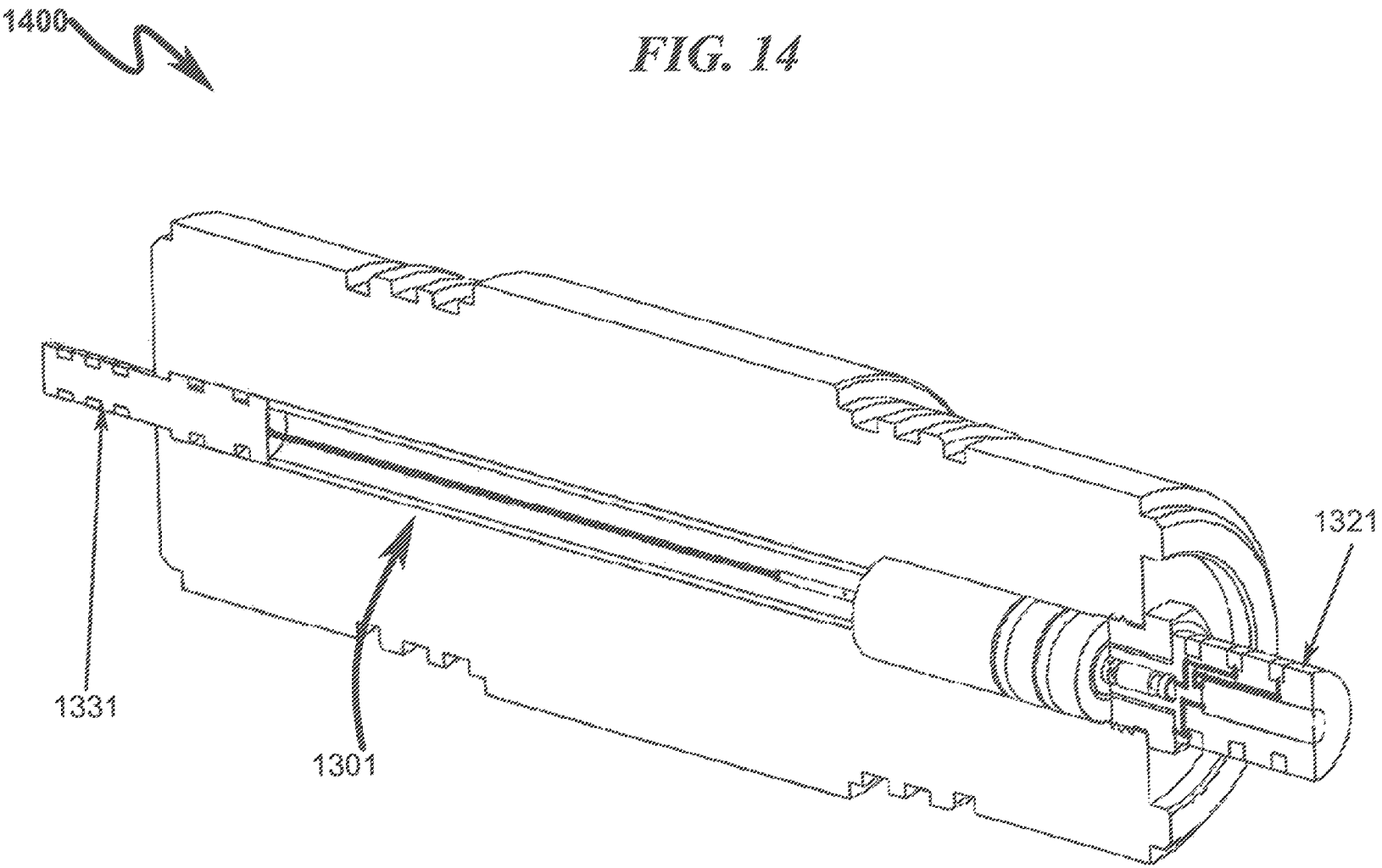
FIG. 14 illustrates an exemplary perspective view of a 2 part switch sub with no port with a detonator depicting a presently preferred embodiment of the present invention.

The present invention may be seen in more detail as generally illustrated in FIG. 13 (1300), wherein a switch sub (1300) comprises an upstream adapter (1331) and a downstream adapter (1321). It should be noted that the term "downstream sub end" (1320) is used to indicate a position that is in the direction towards the toe end of the wellbore casing, and the term "upstream sub end" (1330) is used to indicate a position that is in the direction closer towards the heel end of the wellbore casing. The switch sub (1300) may be attached to an upstream end of perforating gun with the downstream adapter (1321). Similarly, the switch sub may be attached to a downstream end of perforating gun with the upstream adapter (1331). The upstream adapter (1331) may be a different size than the downstream adapter (1321) for preventing undesired or improper electrical connections. The sizes of the upstream adapter (1331) and the downstream adapter are chosen such that the switch sub may not be flipped/reversed, which may result in incorrect/improper electrical connections and assembly of the gun string. According to a preferred exemplary embodiment, the sizes of the upstream adapter and downstream adapters are different for safety purposes. The downstream adapter (1321) may have a primary explosive or a detonator connected, while the upstream adapter (1331) may not have a detonator connected. The downstream adapter (1321) may comprise plural electrical contacts, which include a through wire contact (1303), a ground wire contact (1305), and a power wire contact (1304). Similarly, the upstream adapter (1331) may comprise plural electrical contacts, which include a through wire contact (1313), a ground wire contact (1315), and a power wire contact (1314). The downstream adapter in the switch sub (1300) may be configured to accept a switch that is connected to detonator (1302) as described above in FIG. 7 (0700). According to a preferred exemplary embodiment, the upstream adapter is attached to a downstream end of a perforating gun providing electrical connection through the electrical contacts of the adapter and the electrical contacts of the perforating gun. According to another preferred exemplary embodiment, the downstream adapter is attached to an upstream end of a perforating gun providing electrical connection through the electrical contacts of the downstream adapter and the electrical contacts of the perforating gun. The upstream adapter (1331), and the downstream adapter (1321) may be electrically connected with conducting rods (1301) or through wires. According to a preferred exemplary embodiment, the upstream adapter (1331), the detonator and the downstream adapter (1321) may be electrically connected into a single cartridge. According to yet another preferred exemplary embodiment, the cartridge may be loaded through a single end into the switch sub. According to yet another preferred exemplary embodiment, the cartridge may be tested independently with a perforating gun. According to yet another preferred exemplary embodiment, the switch sub survives a perforating event and remains. The switch sub (1300) may contain ports for testing purposes.

System Summary

The present invention system anticipates a wide variety of variations in the basic theme of perforating, but can be generalized as a wellbore perforating system for use in a wellbore casing comprising:

(a) a first wired perforating gun; and (b) a wired switch sub;

wherein the first wired perforating gun comprises a first charge holder tube; the first charge holder tube is wired with a first cable comprising a first plurality of conducting wires; the first plurality of conducting wires are in operative electrical connection to a first plurality of electrical contacts; the first plurality of electrical contacts are located at a first upstream gun end in an end plate of the first wired perforating gun;

the wired switch sub comprises a downstream sub end; the downstream sub end having a downstream adapter; and the downstream adapter is configured to be screwed to the first upstream gun end; the downstream adapter is configured with a plurality of downstream sub electrical contacts; the plurality of downstream sub electrical contacts are each configured for operative connection to the first plurality of electrical contacts.

This general system summary may be augmented by the various elements described herein to produce a wide variety of invention embodiments consistent with this overall design description.

Method Summary

The present invention method anticipates a wide variety of variations in the basic theme of implementation, but can be generalized as a wellbore perforating method wherein the method is performed on a wellbore perforating system comprising:

(a) a first wired perforating gun; and (b) a wired switch sub;

wherein the first wired perforating gun comprises a first charge holder tube; the first charge holder tube is wired with a first cable comprising a first plurality of conducting wires; the first plurality of conducting wires are in operative electrical connection to a first plurality of electrical contacts; the first plurality of electrical contacts are located at a first upstream gun end in an end plate of the first wired perforating gun;

the wired switch sub comprises a downstream sub end; the downstream sub end having a downstream adapter; and the downstream adapter is configured to be screwed to the first upstream gun end; the downstream adapter is configured with a plurality of downstream sub electrical contacts; the plurality of downstream sub electrical contacts are each configured for operative connection to the first plurality of electrical contacts;

wherein the method comprises the steps of:

(1) attaching the wired switch sub to the first wired perforating gun in a gun string assembly;

(2) repeating the step (1) until desired number of wired perforating guns are attached to wired switch subs in the gun string assembly;

(3) deploying the gun string assembly into the wellbore casing with a wireline comprising the first cable;

(4) isolating a perforating stage in the wellbore casing;

(5) firing the first wired perforating gun that is positioned at a downstream end of the wellbore casing with a trigger signal in one of the pluralities of first conducting wires in the first cable;

(6) activating a switch in the wired switch sub and electrically disconnecting the first wired perforating gun;

(7) pulling the gun string assembly upstream with the switch activated and firing the second wired perforating gun with a detonator positioned upstream of the second wired perforating gun;

(8) checking whether all perforation stages have been completed, if not, proceeding to the step (5); and (9) pulling the gun string assembly out of the wellbore casing and preparing for the next isolated stage.

This general method summary may be augmented by the various elements described herein to produce a wide variety of invention embodiments consistent with this overall design description.

System/Method Variations

The present invention anticipates a wide variety of variations in the basic theme of oil and gas perforations. The examples presented previously do not represent the entire scope of possible usages. They are meant to cite a few of the almost limitless possibilities.

This basic system and method may be augmented with a variety of ancillary embodiments, including but not limited to an embodiment further comprises a second wired perforating gun, wherein: the second wired perforating gun comprises a second charge holder tube; the second charge holder tube is wired with a second cable comprising a second plurality of conducting wires; the second plurality of conducting wires are in operative electrical connection to a second plurality of electrical contacts; the second plurality of electrical contacts are located at a second downstream gun end in an end plate of the second wired perforating gun; wherein the wired switch sub further comprises a upstream sub end; the upstream sub end having an upstream adapter; and wherein the upstream adapter is configured to be screwed to the second downstream gun end; the upstream adapter is configured with a plurality of upstream sub electrical contacts; the plurality of upstream sub electrical contacts are each configured for operative connection to one of a plurality of the second electrical contacts in the second downstream gun end.

In another embodiment, the downstream adapter is configured to accept a detonator; wherein the detonator is configured to be connected to a switch; and whereby when perforating, and the detonator is received in the downstream adapter, the detonator transfers a ballistic event to a detonating cord in a the first wired perforating gun.

In another embodiment, the switch is configured to an operative electrical connection to the upstream adapter.

In another embodiment, the switch is a pressure activated switch.

In another embodiment, the switch is an electronic switch.

In another embodiment, the upstream adapter and the downstream adapter are configured to connect to each other to form a cartridge.

In another embodiment, the cartridge is loaded from one end of the wired switch sub.

In another embodiment, said switch is configured with a pre-determined electronic time delay.

In another embodiment, the switch is configured with a pre-determined ballistic time delay.

In another embodiment, the activating of a switch is initiated by an output of a detonator.

Wired Perforating Gun System Summary

The present invention system anticipates a wide variety of variations in the basic theme of perforating, but can be generalized as wellbore perforating gun system for use in a wellbore casing comprising a wired perforating gun; the wired perforating gun comprises a charge holder tube; the charge holder tube is wired with a cable comprising a plurality of conducting wires; the plurality of conducting wires are configured for operative electrical connections to a switch sub.

Wired Perforating Gun System/Method Variations

The present invention anticipates a wide variety of variations in the basic theme of oil and gas perforations. The examples presented previously do not represent the entire scope of possible usages. They are meant to cite a few of the almost limitless possibilities.

This basic system and method may be augmented with a variety of ancillary embodiments, including but not limited to an embodiment wherein the charge holder tube comprises a plurality of holes; the plurality of holes are configured to allow the cable to pass through.

This system and method may be augmented with a an embodiment wherein the plurality of conducting wires are each configured for operative electrical connection to one of a plurality of electrical contacts; the plurality of electrical contacts are positioned in an end plate in the charge holder tube.

This system and method may be augmented with an embodiment wherein the cable is held by fastening means.

This system and method may be augmented with an embodiment wherein the cable is routed with clips attached to the charge holder tube.

This system and method may be augmented with an embodiment wherein the holes are machined at pre-determined points in the charge holder tube.

This system and method may be augmented with an embodiment wherein the cable further comprises three conducting wires.

This system and method may be augmented with an embodiment wherein the cable further comprises a ground wire, a through wire and a fire wire.

This system and method may be augmented with an embodiment wherein the cable further comprises a ground wire, a through wire, a fire wire and a communication wire.

This system and method may be augmented with an embodiment wherein the communication wire is configured to receive instructions electronically.

This system and method may be augmented with an embodiment wherein the communication wire is configured to transmit status electronically.

This system and method may be augmented with an embodiment wherein the cable is held by clips in the charge holder tube.

One skilled in the art will recognize that other embodiments are possible based on combinations of elements taught within the above invention description, but that at least one embodiment is directed to a wellbore perforating system and method with reliable and safer connections in a perforating gun assembly. The system/method includes a gun string assembly (GSA) deployed in a wellbore with multiple perforating guns attached to plural switch subs. The perforating guns are pre-wired with a cable having multi conductors; the multi conductors are connected to electrical ring contacts on either end of the perforating guns. The switch subs are configured with electrical contacts that are attached to the electrical contacts of the perforating guns without the need for manual electrical connections and assembly in the field of operations. The system further includes detonating with a detonator that is positioned upstream of the perforating gun. The detonator is wired to a switch that is positioned downstream of the perforating gun.

The invention claimed is:

1. A switch sub comprising:

an upstream adapter positioned at an upstream end of the switch sub, wherein the upstream adapter comprises at least a first electrical contact;

a downstream adapter positioned at a downstream end of the switch sub, wherein the downstream adapter comprises at least a second electrical contact;

a plurality of conducting elements extending through the switch sub from the upstream end to the downstream end, wherein the at least a first electrical contact is connected to the at least a second electrical contact by one of the plurality of conducting element; and a detonator located in the downstream adapter, wherein the upstream adapter, the downstream adapter and the detonator form a slidably removable cartridge, and wherein the slidable removable cartridge is configured to slide into a bore of the switch sub.

2. The switch sub of claim 1, further comprising: a switch connected to a through wire contact, a ground wire contact, and a power wire contact.

3. The switch sub of claim 1, wherein the upstream adapter has a first size, and wherein the downstream adapter has a second size that is different from the first size.

4. The switch sub of claim 3, wherein the downstream adapter is configured to be electrically connected directly to an upstream end of a downstream perforating gun, and wherein the upstream adapter is configured to be electrically connected directly to a downstream end of an upstream perforating gun.

5. The switch sub of claim 1, wherein the plurality of conducting elements is a conducting rod, a through-wire, or combinations thereof.

6. The switch sub of claim 1, wherein the downstream adapter has a hollow body.

7. The switch sub of claim 1, wherein the downstream adapter is configured to accept a switch, and wherein the switch is connected to the detonator through the downstream adapter.

8. The switch sub of claim 1, wherein the upstream adapter, the downstream adapter and the detonator are electrically connected to form the slidably removable cartridge.

9. The switch sub of claim 1, wherein the bore of the switch sub comprises a cavity in communication with an aperture at one end, wherein the cavity and the aperture are sized to receive the slidably removable cartridge.

10. The switch sub of claim 1, wherein the slidably removable cartridge enters inside the switch sub through one end of the switch sub.

11. A single switch sub comprising:

a switch located inside of a bore of the switch sub;

a first adapter positioned at a first end of the switch sub, wherein the first adapter comprises at least a first electrical contact;

a second adapter positioned at a second end of the switch sub, wherein the second adapter comprises at least a second electrical contact; and a detonator located in the second adapter, wherein the first adapter, the second adapter and the detonator form a slidably removable cartridge, and wherein the slidable removable cartridge is configured to slide into the bore of the switch sub.

12. The switch sub of claim 11, wherein the switch is connected to a through wire contact, a ground wire contact, and a power wire contact.

13. The switch sub of claim 11, wherein the first adapter has a first size, and wherein the second adapter has a second size that is different from the first size.

14. The switch sub of claim 13, wherein the second adapter is configured to be electrically connected directly to a first perforating gun, and wherein the first adapter is configured to be electrically connected directly to a second perforating gun.

15. The switch sub of claim 11, further comprising:

a plurality of conducting elements extending through the switch sub from the first end to the second end, wherein the at least a first electrical contact is connected to the at least a second electrical contact by one of the plurality of the conducting elements.

16. The switch sub of claim 11, wherein the switch is an electronic switch.

17. The switch sub of claim 11, wherein the slidably removable cartridge is configured to accept the switch, and wherein the switch is connected to the detonator through the second adapter.

18. The switch sub of claim 11, wherein the first adapter, the second adapter and the detonator are electrically connected to form the slidably removable cartridge.

19. The switch sub of claim 18, wherein the bore of the switch sub comprises a cavity in communication with an aperture at one end, wherein the cavity and the aperture are sized to receive the slidably removable cartridge.

20. The switch sub of claim 11, wherein the slidably removable cartridge enters inside the switch sub through one end of the switch sub.

* * * * *